US009914069B2

(12) United States Patent
Lehman et al.

(10) Patent No.: US 9,914,069 B2
(45) Date of Patent: Mar. 13, 2018

(54) FLYING DISC

(71) Applicants: Kenn W. Lehman, Fort Wayne, IN (US); Rose E. Lehman, Fort Wayne, IN (US)

(72) Inventors: Kenn W. Lehman, Fort Wayne, IN (US); Rose E. Lehman, Fort Wayne, IN (US)

( * ) Notice: Subject to any disclaimer, the term of this patent is extended or adjusted under 35 U.S.C. 154(b) by 0 days.

(21) Appl. No.: 15/457,994

(22) Filed: Mar. 13, 2017

(65) Prior Publication Data

US 2017/0312647 A1 Nov. 2, 2017

Related U.S. Application Data

(60) Provisional application No. 62/329,152, filed on Apr. 28, 2016.

(51) Int. Cl.
*A63H 33/18* (2006.01)
*A63H 27/00* (2006.01)
*A63H 33/22* (2006.01)

(52) U.S. Cl.
CPC ..... *A63H 33/18* (2013.01); *A63H 27/00* (2013.01); *A63H 33/22* (2013.01)

(58) Field of Classification Search
CPC ..... A63H 33/18
USPC ..... 446/46, 48, 487; 473/588, 589
See application file for complete search history.

(56) References Cited

U.S. PATENT DOCUMENTS 115,252 A * 5/1871 Spencer ..... A63B 39/00 473/612
513,560 A * 1/1894 Dickey ..... A63B 39/00 473/612
2,791,868 A * 5/1957 Reidar ..... A63H 33/062 428/11
3,046,016 A * 7/1962 Laws ..... A63F 3/00094 273/241
3,218,071 A * 11/1965 Richard ..... A63B 43/00 446/457
3,742,643 A * 7/1973 Keith ..... A63H 27/12 446/46
3,852,910 A * 12/1974 Everett ..... A63H 33/18 446/46
3,939,602 A * 2/1976 Burke ..... A63H 33/18 446/48
4,117,626 A * 10/1978 Kifferstein ..... A63H 33/18 446/47
4,182,073 A * 1/1980 Tabet ..... A63H 33/18 446/46
4,246,720 A * 1/1981 Stone ..... A63H 33/18 446/47
4,257,605 A * 3/1981 Bancroft ..... F41J 9/02 273/109
4,315,629 A * 2/1982 English ..... A63H 33/18 473/589
4,362,031 A * 12/1982 Obermuller ..... A44C 13/00 63/10
4,425,734 A * 1/1984 Bauer ..... A63H 33/18 446/48

(Continued)

*Primary Examiner* — Alexander Niconovich
(74) *Attorney, Agent, or Firm* — Faegre Baker Daniels LLP

(57) ABSTRACT

A flying disc device appears to "flutter" in flight when rotating. The design is interesting and visually appealing when in use, is easy to see in flight, and can be easily retrieved when laying flat on the ground or another flat surface owing to its angularly oriented dual-disc design.

22 Claims, 15 Drawing Sheets

(56) References Cited

U.S. PATENT DOCUMENTS 4,596,726 A * 6/1986 Wrzalinski ..... A47G 33/08 428/102
D285,109 S 8/1986 Jornhagen
D285,247 S 8/1986 Jornhagen
4,752,267 A * 6/1988 Layman ..... A63H 33/18 446/46
D301,156 S 5/1989 Bullard
4,850,927 A * 7/1989 Caranica ..... A63H 3/003 446/369
4,854,907 A 8/1989 Holmes
4,955,841 A * 9/1990 Pastrano ..... A63H 33/18 446/46
4,974,844 A * 12/1990 Richards ..... A63B 43/002 273/DIG. 20
5,020,808 A * 6/1991 Richards ..... A63H 33/18 446/48
5,080,624 A * 1/1992 Brinker ..... A63H 27/12 446/266
D324,000 S 2/1992 Kvistad
5,100,356 A * 3/1992 Atwell ..... A63H 33/18 446/112
5,131,879 A * 7/1992 Bouchakian ..... A63H 33/18 446/48
5,195,916 A * 3/1993 Her ..... A63H 33/18 446/255
D336,119 S 6/1993 Bridge, Jr.
5,224,959 A * 7/1993 Kasper ..... A63B 21/0084 446/26
D346,626 S 5/1994 St. Lawrence
5,326,299 A * 7/1994 Jasinski ..... A63H 33/18 446/46
5,358,440 A * 10/1994 Zheng ..... A63H 33/18 446/46
D354,525 S 1/1995 Sullivan
5,417,602 A * 5/1995 McGraw ..... A63H 33/18 446/46
D362,470 S 9/1995 Smith
D369,191 S 4/1996 Dunipace
5,674,102 A * 10/1997 Lin ..... A63H 33/18 446/46
5,679,082 A * 10/1997 Hincke ..... A63H 23/12 473/588
5,797,815 A * 8/1998 Goldman ..... A63H 33/18 446/46
D402,318 S 12/1998 Dunipace
5,853,311 A * 12/1998 Bartholomew ..... A63H 33/18 446/48
D406,282 S 3/1999 Pinguelo
D412,724 S 8/1999 Raundahl
D414,823 S 10/1999 Gardner
6,089,939 A * 7/2000 Dyson ..... A63H 33/18 446/46
D445,461 S 7/2001 Vodhanel, Jr.
D449,082 S 10/2001 Levine
D453,359 S 2/2002 Naslund
6,422,959 B1 * 7/2002 Hsu ..... A63H 33/18 446/46
6,468,123 B1 * 10/2002 Valencia ..... A63H 33/18 446/48
D478,944 S 8/2003 Peterson
6,622,659 B2 * 9/2003 Willinger ..... A01K 15/025 119/702
6,805,077 B2 * 10/2004 Goldman ..... A01K 15/025 119/707
D501,517 S 2/2005 Vodhanel, Jr.
6,863,588 B1 * 3/2005 Chu ..... A63B 43/00 446/46
6,896,577 B1 * 5/2005 Feng ..... A63H 33/18 446/46
D524,877 S 7/2006 Kort et al.
D527,428 S 8/2006 Cooper
D559,920 S 1/2008 Krueger et al.
D572,315 S 7/2008 Sowinski
7,976,355 B2 7/2011 McAnulty
D644,727 S 9/2011 Salus
D659,197 S 5/2012 Slone et al.
D678,422 S 3/2013 Thompson
D681,741 S 5/2013 Lederman et al.
D691,673 S 10/2013 Vazquez
D714,398 S 9/2014 Oblack et al.
D725,197 S 3/2015 Thompson
D725,713 S 3/2015 Thompson
D725,714 S 3/2015 Kim
D729,322 S 5/2015 Fisher
9,039,479 B1 * 5/2015 Green ..... A63H 33/18 446/46
D751,651 S 5/2016 Lehman et al.
9,345,984 B2 * 5/2016 White ..... A63H 33/18
2003/0148702 A1 * 8/2003 Campbell ..... A63B 19/00 446/236
2008/0090486 A1 * 4/2008 Zawitz ..... A63H 33/008 446/124
2014/0127963 A1 * 5/2014 Wechsler ..... A63H 33/18 446/48
2016/0346628 A1 * 12/2016 Tiefel ..... A63H 33/18

* cited by examiner

FLYING DISC

CROSS REFERENCE TO RELATED APPLICATION

This application claims priority under 35 U.S.C. § 119 to U.S. Provisional Patent Application No. 62/329,152, filed Apr. 28, 2016 and entitled "Flying Disc", the entire disclosure of which is hereby incorporated by reference herein.

FIELD OF THE DISCLOSURE

The present disclosure relates to a toy device, and specifically, a flying disc device.

BACKGROUND OF THE DISCLOSURE

Throwing and catching flying discs is a popular activity among humans as well as between humans and their pets. In use, traditional flying discs can be difficult to catch when in flight at high speeds due to the solid materials from which they are made as well as their unforgiving structure, particularly at the rim of the disc. Traditional flying discs can also be difficult to pick up off the ground depending on the flying disc's orientation as it lays on the surface. For example, when the flying disc is lying "face down" on the ground (grass, concrete, asphalt, etc.) such that the inside of the disc is facing downwards (dome-shape upwards), a user must reach underneath the dome of the traditional flying disc to pick it up. This can be difficult as a user would have to wedge their fingers between the ground and the disc to gain enough leverage to elevate the flying disc. Similarly, dogs attempting to pick up a traditional flying disc lying face down may encounter difficulty getting a firm grasp on the edge of the disc.

An improvement is needed over traditional flying discs.

SUMMARY

The present disclosure provides a flying disc device having an angularly oriented dual-disc design which appears to "flutter" in flight when rotating. The design is interesting and visually appealing when in use, and facilitates in-flight retrieval by providing a distinctive in-flight "flutter." The design is also easy to catch from the air, and can be easily retrieved when laying flat on the ground or another flat surface.

According to an embodiment of the present disclosure, a flying disc is provided. The flying disc includes: a first annular ring defining a first longitudinal axis, a first outer annular diameter and a first inner annular diameter; and a second annular ring defining a second longitudinal axis, a second outer annular diameter and a second inner annular diameter; a first pair of antipodal points of the first annular ring joined with a corresponding second pair of antipodal points of the second annular ring such that a pair of antipodal junctions are formed between the first and second annular rings, the first annular ring skewed with respect to the second annular ring such that an angle is formed between the first and second longitudinal axes, and the angle is between 10 degrees and 30 degrees.

According to an embodiment of the present disclosure, the flying disc includes a first annular ring defining a first longitudinal axis, a first outer annular diameter and a first inner annular diameter; and a second annular ring defining a second longitudinal axis, a second outer annular diameter and a second inner annular diameter; a first pair of antipodal points of the first annular ring joined with a corresponding second pair of antipodal points of the second annular ring such that a pair of antipodal junctions are formed between the first and second annular rings, the first annular ring skewed with respect to the second annular ring such that an angle is formed between the first and second longitudinal axes, and at least one annular rib formed around an outer periphery of at least one of the first annular ring and the second annular ring.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 13:
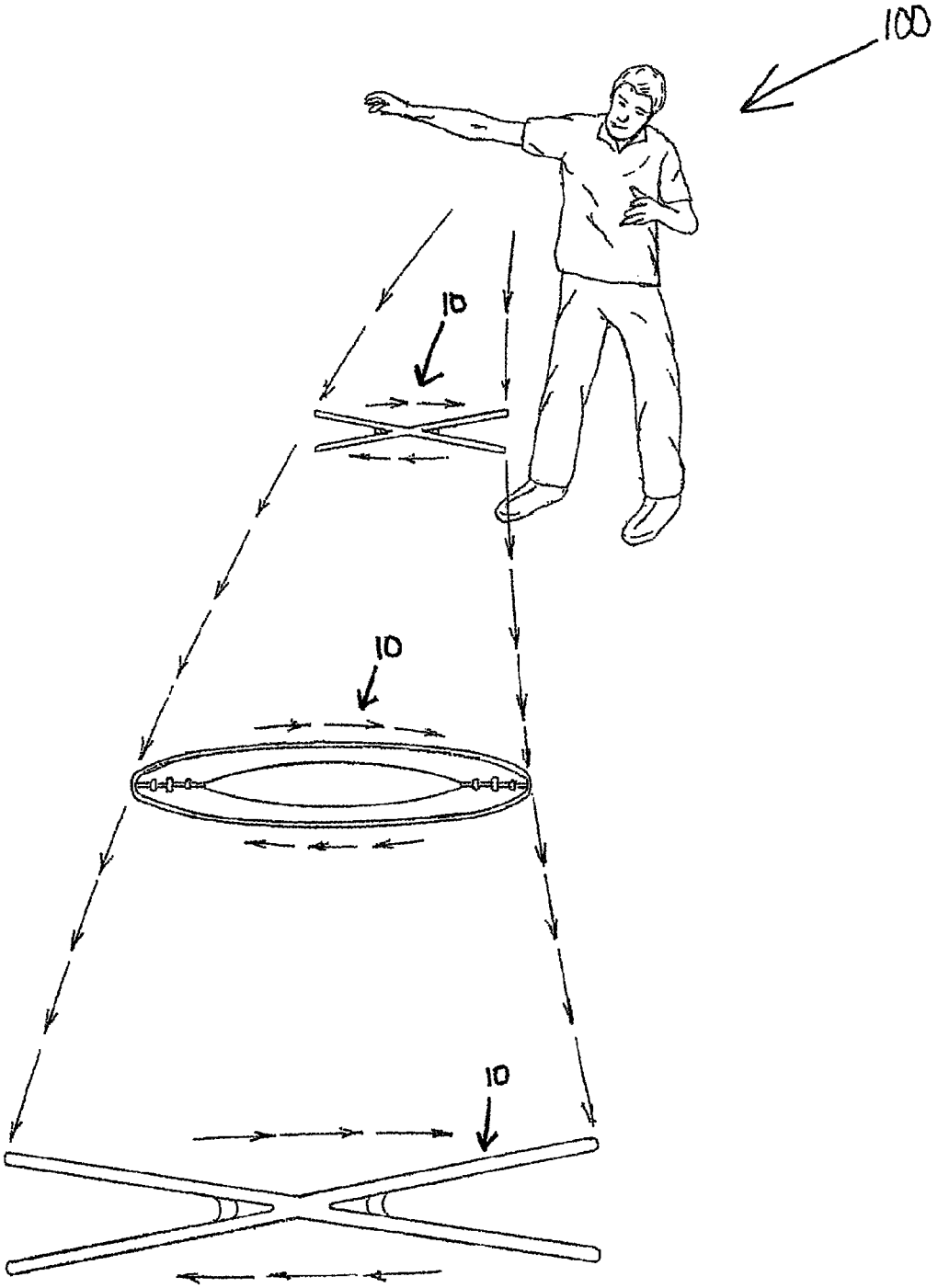
FIG. 13 is a perspective view of a flying disc device made in accordance with the present disclosure, showing the disc in various positions from the perspective of a disc catcher after the disc has been thrown by a thrower.

Referring first to FIG. 13, a perspective view of a flying disc device 10 is shown in various positions from the perspective of a disc catcher (not shown) after the disc has been thrown by a thrower 100. As shown, when flying disc device 10 is in flight, disc device 10 rotates and its angular orientation varies such that it appears to "flutter" because of its dual disc design as described further below.

Figure 1:
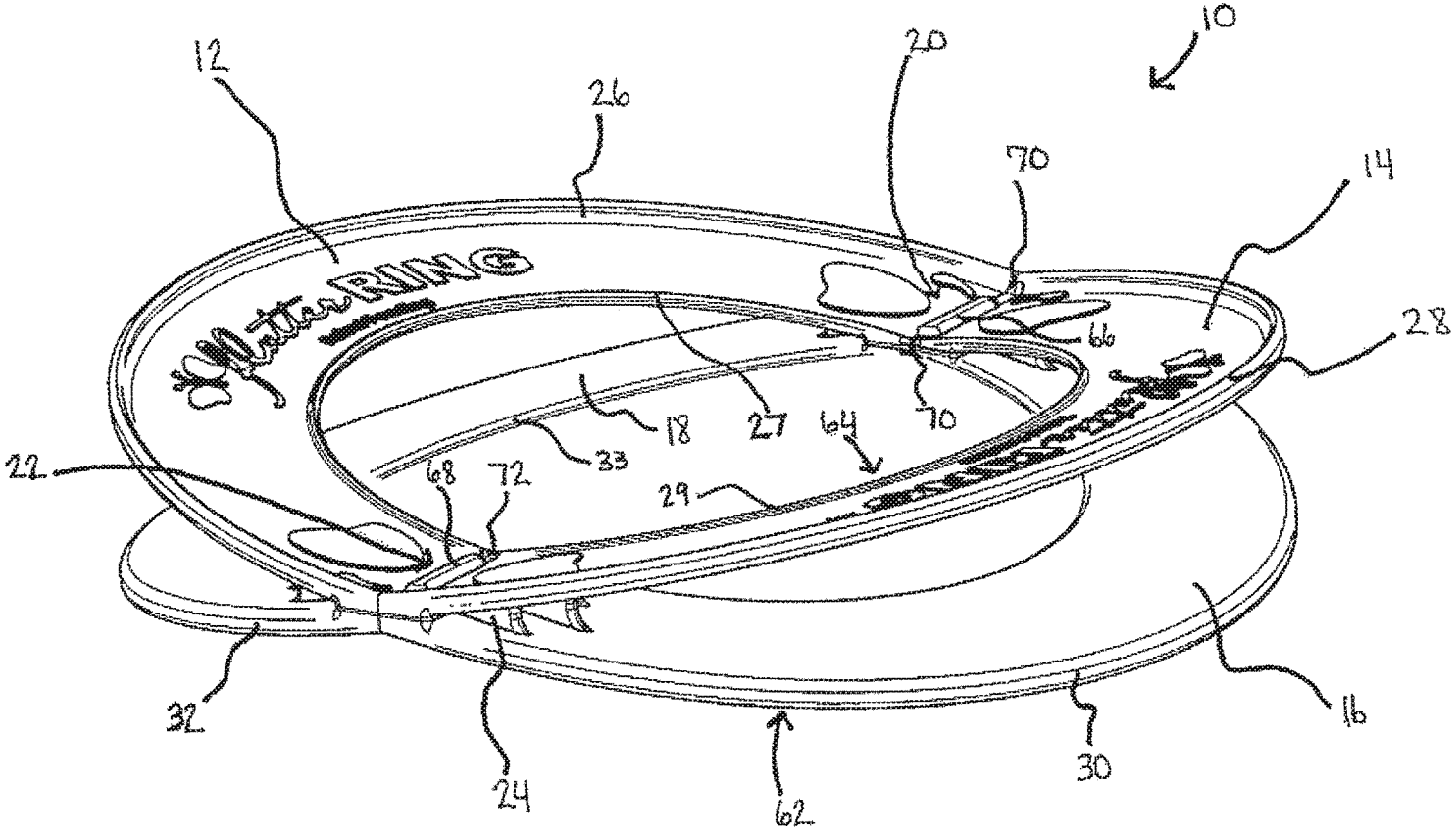
FIG. 1 is a perspective view of a flying disc device made in accordance with the present disclosure.
Figure 2:
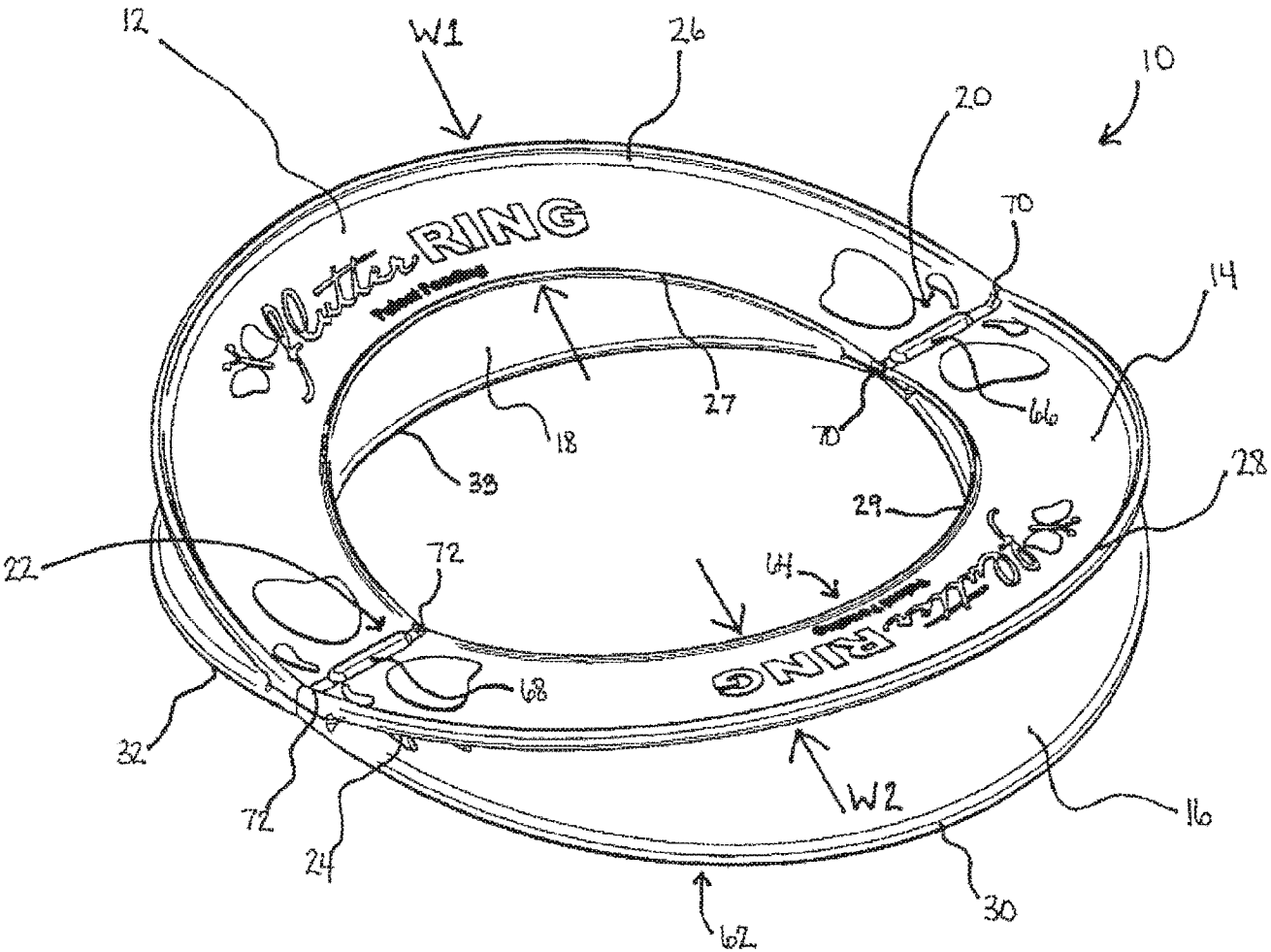
FIG. 2 is another perspective view of the flying disc device of FIG. 1.
Figure 3:
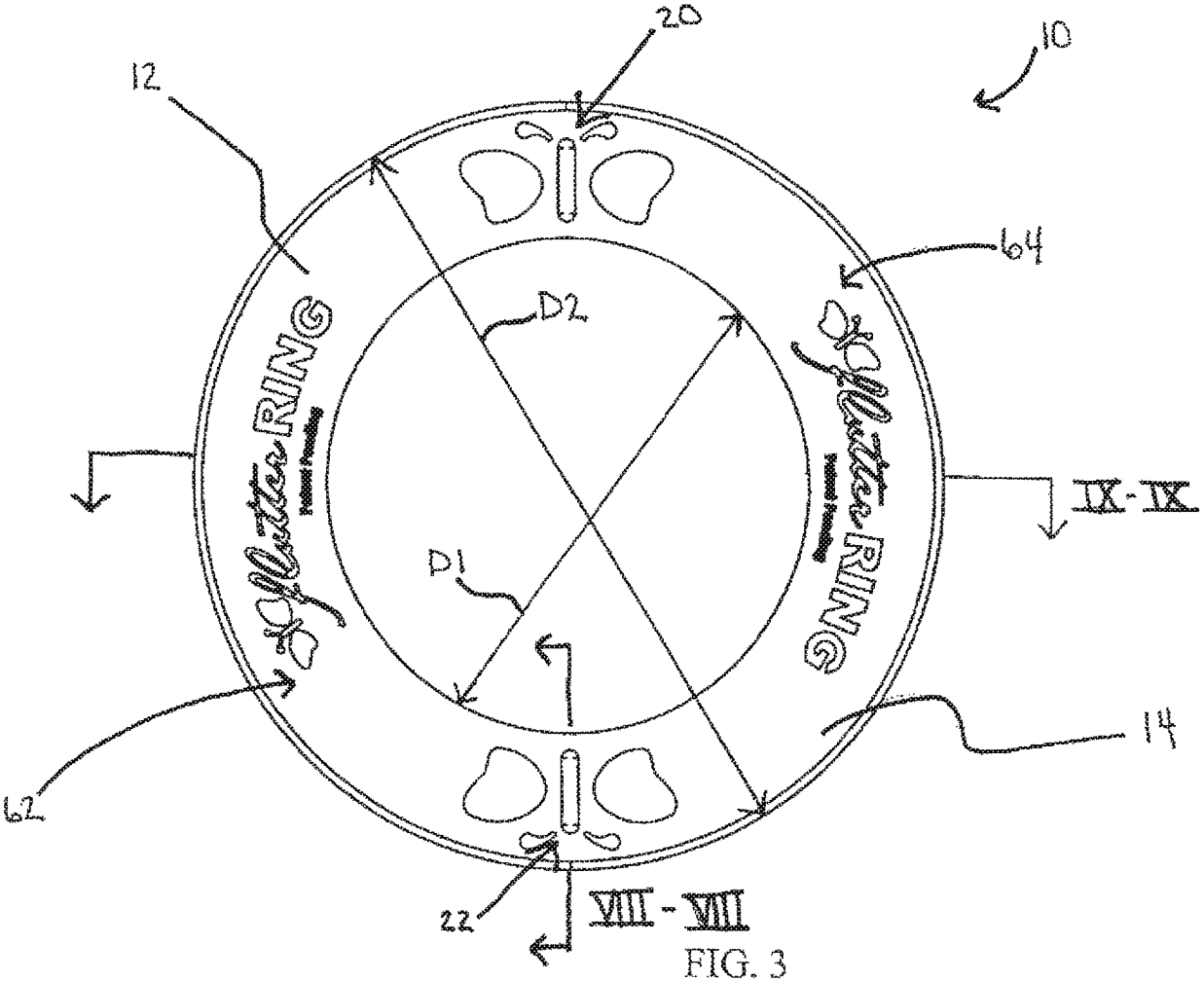
FIG. 3 is a top plan view of the flying disc device of FIG. 1.
Figure 9:
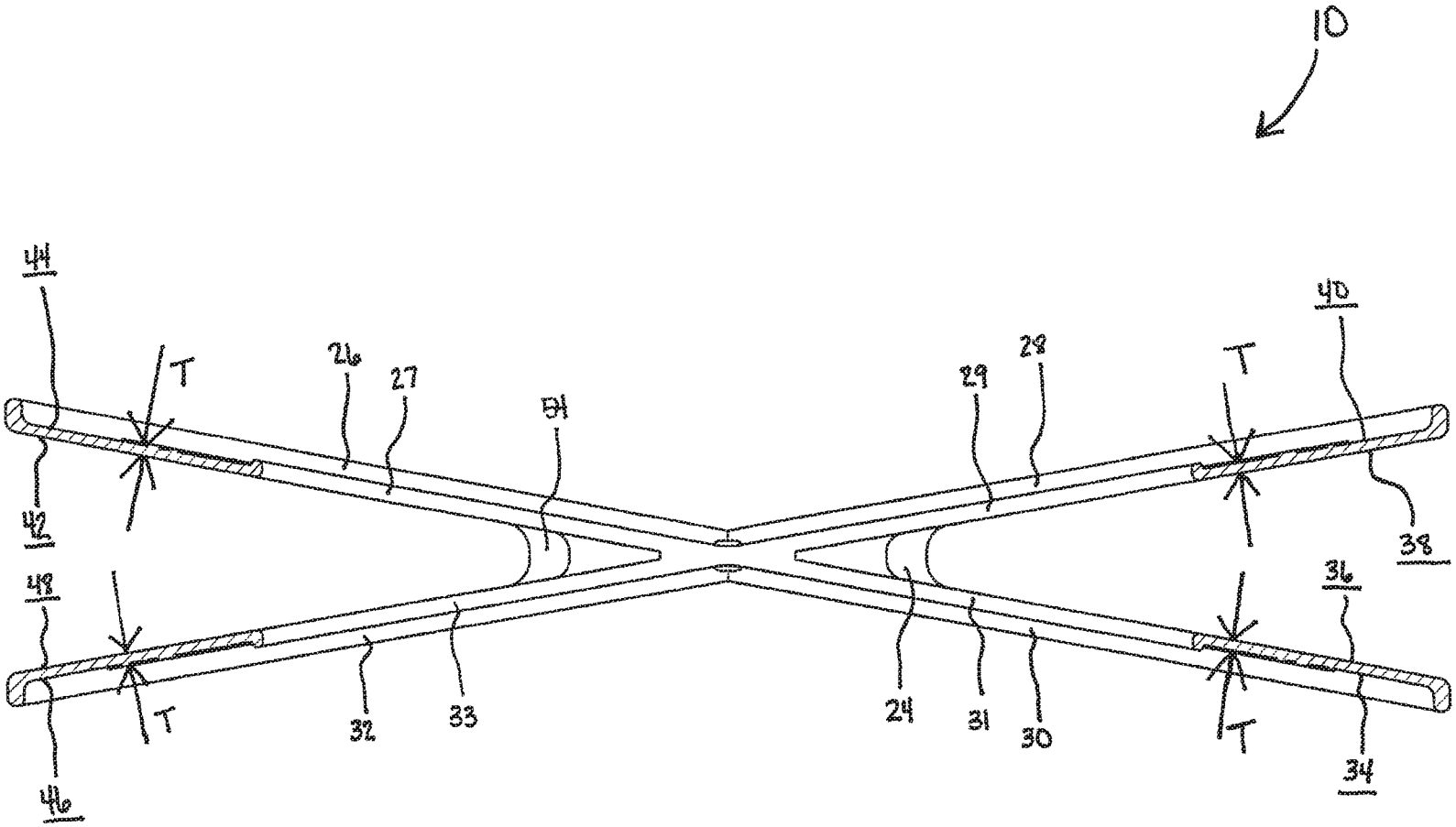
FIG. 9 is a side elevation, section view of the flying disc device of FIG. 1, taken through the line IX-IX of FIG. 3.
Figure 12:
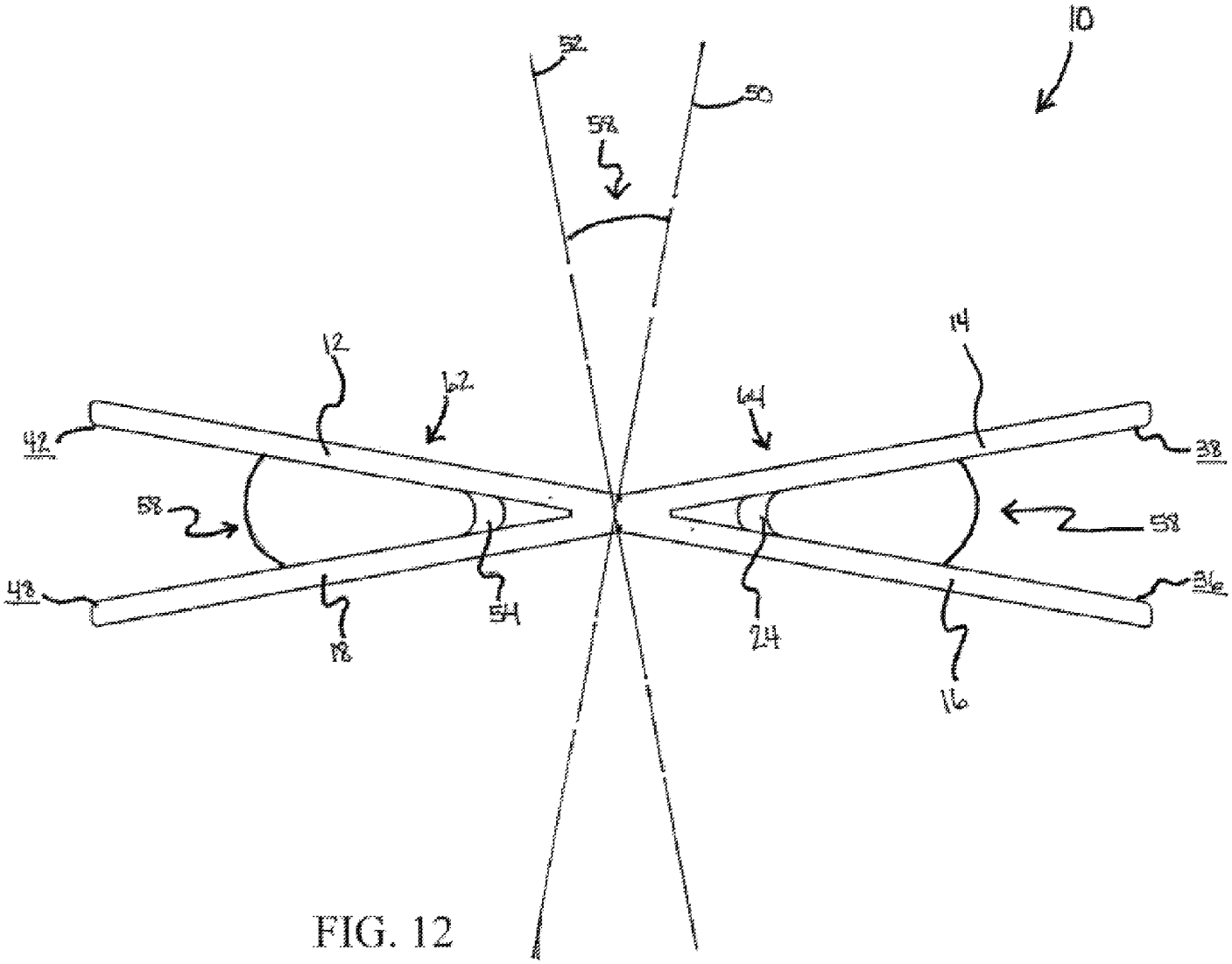
FIG. 12 is a side, elevation view of the flying disc device of FIG. 1.

Referring to FIGS. 1-5, flying disc device 10 comprises four annular ring halves 12, 14, 16, and 18 angularly oriented with respect to one another to form an "X" shaped side profile as best shown in FIGS. 9 and 12. As illustrated in FIGS. 1 and 2, annular ring halves 12, 16 cooperate to form a substantially planar, circular annular ring 62 defining inner diameter $D_1$ and outer diameter $D_2$ (FIG. 3). Similarly, annular ring halves 14, 18 cooperate to form a second substantially planar, circular annular ring 64 (FIG. 1) with the same inner diameter $D_1$ and outer diameter $D_2$. In an exemplary embodiment, inner diameter $D_1$ of annular rings may be as little as 2 inches, 4 inches, 6 inches, or 8 inches as great as 12 inches, 14 inches, 16 inches, or 18 inches, or may be within any ranged defined between any two of the foregoing values. In an exemplary embodiment, outer diameter $D_2$ of annular rings 62, 64 may be as little as 4 inches, 6 inches, or 8 inches as great as 12 inches, 14 inches, 16 inches, 18 inches, or 20 inches, or may be within any ranged defined between any two of the foregoing values. Although the inner diameters $D_1$ and outer diameters $D_2$ of annular rings 62 and 64 are substantially equal to one another in the illustrated embodiment (i.e., rings 62 and 64 are about the same size or can be exactly the same size), it is contemplated that these diameters may vary between the two rings 62, 64 in alternative embodiments.

In an exemplary embodiment, outer diameter $D_2$ and inner diameter $D_1$ define a ratio which is set to a desired, flight-enhancing nominal value regardless of the overall size of disc device 10. For example, this $D_2$:$D_1$ ratio may be as little as 1.4, 1.5 or 1.6, and may be as great as 1.7, 1.8, 1.9 or 2.0, or may be within any range defined between any two of the foregoing values.

In addition to the $D_2$:$D_1$ ratio, annular rings 62, 64 may also be designed with particular, flight-enhancing nominal values for ring widths $W_1$ and $W_2$ (FIG. 2). Widths $W_1$ and $W_2$ are equal to half the difference between the outer and inner diameters, i.e., $W_1=(D_2-D_1)/2$ and $W_2=(D_2-D_1)/2$. In the illustrated embodiment, in which rings 62, 64 are substantially identical, $W_1$ and $W_2$ are substantially equal to one another. In an exemplary embodiment, widths $W_1$ and $W_2$ of annular rings 62 and 64 are between 1 inch and 3 inches, with smaller widths generally corresponding to smaller overall sizes of disc device 10, and larger widths generally corresponding to larger overall sizes of disc device 10.

Turning now to FIG. 3, annular rings 62 and 64 intersect at an angle such that ring halves 12, 14 cooperate to form an upper V-shaped construct and annular ring halves 16, 18 cooperate to form a lower V-shaped construct. These two V-shaped constructs intersect and form two antipodal joints at junctions 66, 68 (FIGS. 1 and 2) to form acute angles 58 (FIG. 12) between the inner surfaces of the two V-shaped constructs.

Stated another way, annular ring halves 12, 16 cooperate to form a generally flat/planar annular ring 62, as noted above, and this ring 62 defines a longitudinal axis 50 (FIG. 12) that is nominally perpendicular to upper surfaces 44, 36 and lower surfaces 42, 34 of ring halves 12, 16. Similarly, annular ring halves 14, 18 cooperate to form a generally flat/planar annular ring 64, which defines a longitudinal axis 52 (FIG. 12) that is nominally perpendicular to upper surfaces 40, 48 and lower surfaces 38, 46 of ring halves 14, 18. Because annular rings 62, 64 are flat (though it is understood that rings 62, 64 may be flexible/deformable in some embodiments), longitudinal axes 50, 52 form the same angle 58 as the V-shaped constructs.

As noted above, annular ring halves 12, 14, 16, 18 include upper surfaces 44, 40, 36, and 48, respectively. Annular ring halves 12, 14, 16, 18 also include respectively opposing lower surfaces 42, 38, 34, and 46, respectively. For purposes of the present disclosure, "upper" and "lower" structures and features are taken with reference to the upper and lower directions as shown in the figures, it being understood that upper and lower surfaces may be inverted or disposed at any angle with respect to gravity when flying disc 10 is in use.

Figure 10:
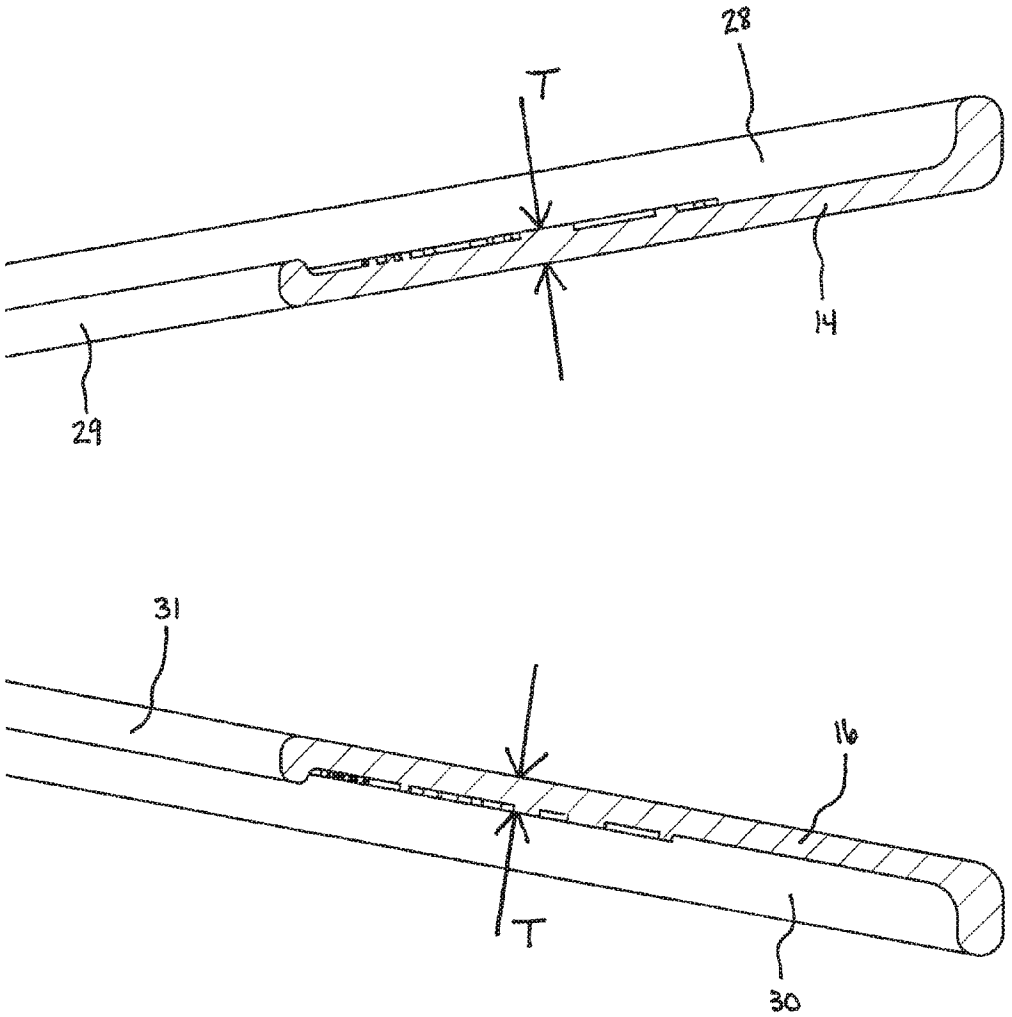
FIG. 10 is an enlarged elevation, section view of a portion of the flying disc device of FIG. 9.
Figure 11:
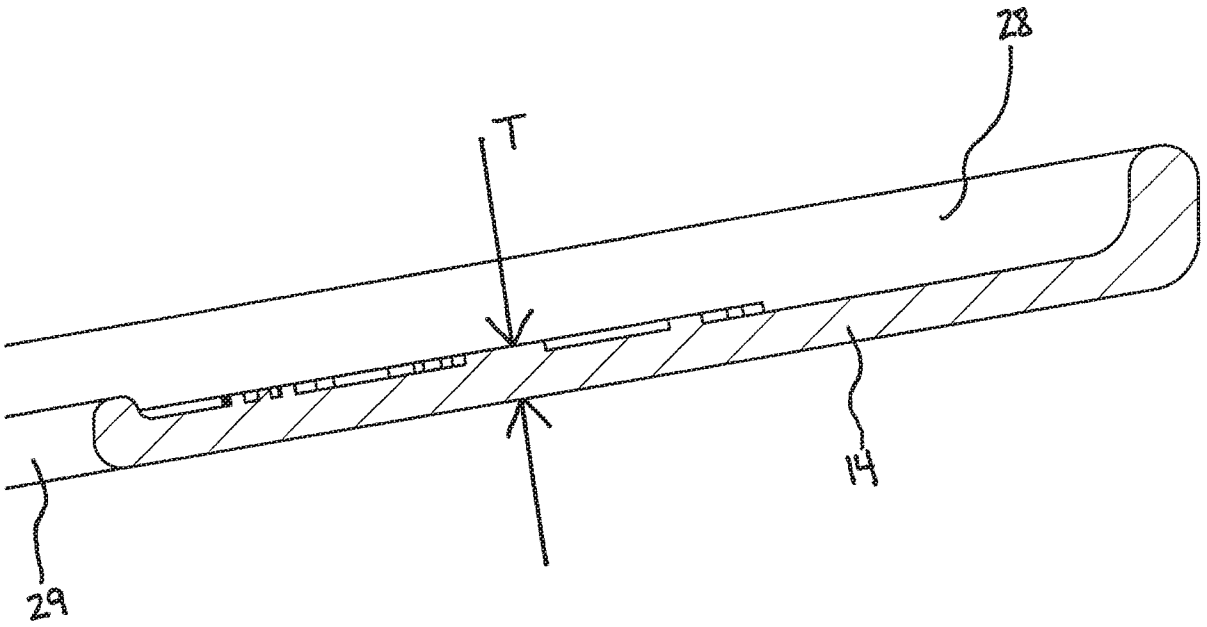
FIG. 11 is an enlarged elevation, section view of a portion of the flying disc device of FIG. 10.

Disc thickness T, best shown in FIGS. 9-11, is generally uniform between each of the opposed upper and lower surfaces of each pair of corresponding annular ring halves. In an exemplary embodiment, this uniformity of thickness T may extend around substantially the entire annular extent for annular rings 62, 64. For example, upper surface 36 and lower surface 34 of annular ring half 16 define thickness T throughout annular ring half 16 and upper surface 44 and lower surface 42 of annular ring half 12 define the same thickness T throughout annular ring half 12. In the aggregate, a uniform thickness T is provided for substantially the entire annular ring 62. However, non-uniform areas of thickness may be defined by certain discrete portions of annular ring halves 12, 14, 16, 18, as further described below.

Figure 8:
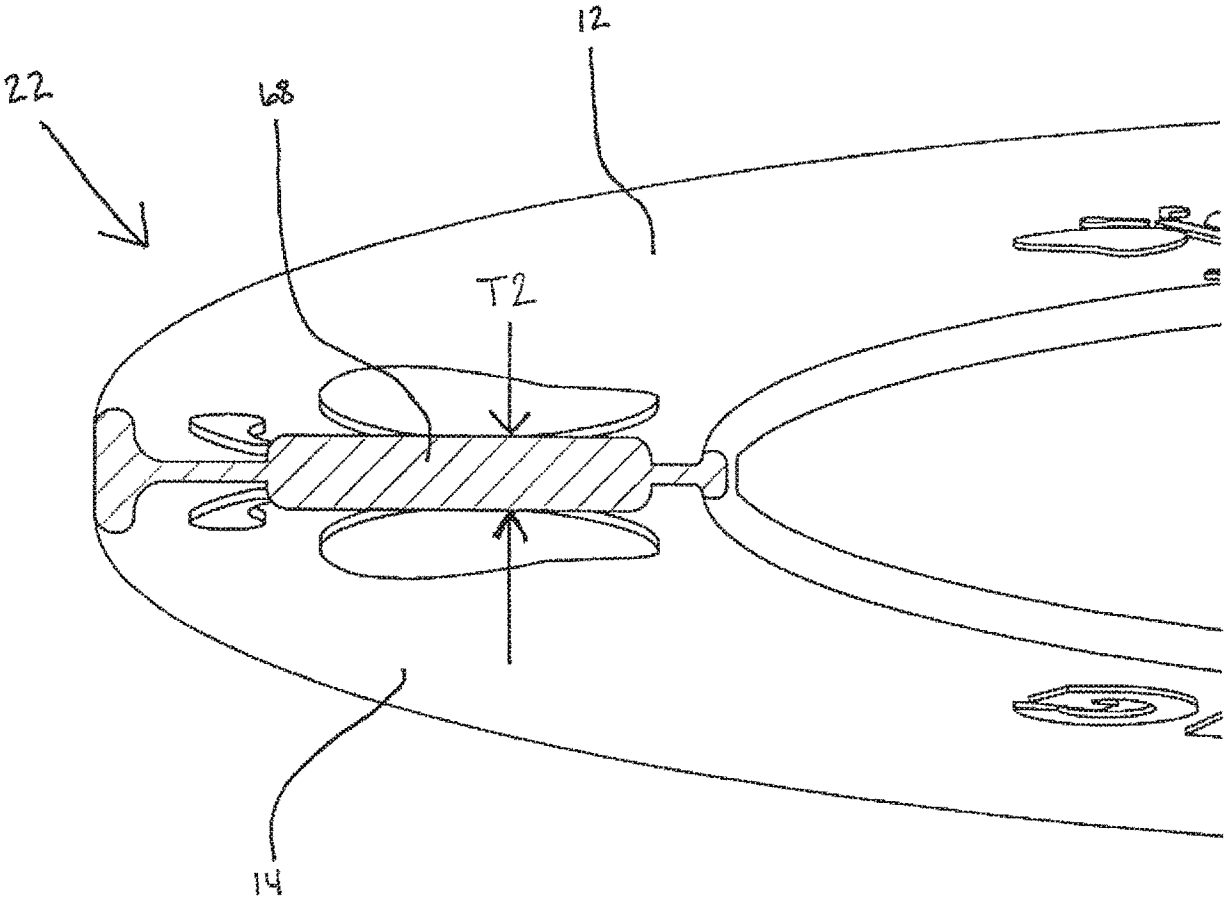
FIG. 8 is an enlarged elevation, section view of the flying disc device of FIG. 1, taken through the line VIII-VIII of FIG. 3.

Turning again to FIG. 1, annular ring halves 12, 14, 16 and 18 are joined at intersection regions 20 and 22. In the illustrated embodiment, intersection regions 20 and 22 are disposed at opposite sides of the generally circular disc 10, thereby forming antipodal junctions 66 and 68 respectively. Stated another way, the two annular rings 62, 64 are joined or fused to one another at points that are 180 degrees apart on each ring 62, 64, i.e., at their respective antipodes. Antipodal junctions 66 and 68 are shown as encompassing an area around antipodal points 70 and 72, respectively, it being understood that the area and volume of the joined material may be varied depending on the strength and resilience needed to maintain the structure of flying ring 10 in normal use. For example, annular rings 62 and 64 may define an increased junction thickness T2 (FIG. 8), greater than thickness T, in the vicinity of antipodal junctions 66 and 68. That is, annular ring halves 12, 14, 16, and 18 may each have a greater thickness in the area near and/or at antipodal junctions 66 and 68, which steps down or tapers off as annular ring halves 12, 14, 16, and 18 extend away from antipodal junctions 66, 68. Having a greater thickness near antipodal junctions 66, 68 provides additional structural strength and support, in conjunction with joiner ribs 24, 54 (best shown in FIG. 4) described herein, at high stress areas of flying disc device 10.

Annular ring halves 12, 14, 16, and 18 intersect to form disc angles 58, as best seen in FIG. 12. As mentioned earlier and also shown in FIG. 12, longitudinal axes 50, 52 of annular rings 62, 64 intersect and also form the same angle 58. The size of angle 58 dictates the flying ability of flying disc device 10. If angle 58 is too large or too small, then flying disc device 10 will not appear as if it is fluttering, in the manner of a butterfly flapping its wings, when in flight. Specifically, when disc angle 58 is too large, flying disc device 10 is unable to fly a great distance when thrown and is difficult for a user to catch as the gap between annular ring halves becomes significantly large. When disc angle 58 is too small, there is no room for a user's fingers between the annular ring halves 12, 18 or 14, 16, and flying disc device 10 is too flat, obviating the advantages (discussed further below) of the shape of flying disc device 10.

Disc angles 58 formed by annular rings 62 and 64 may be set to enhance the performance of flying disc device 10. In an exemplary embodiment, disc angle 58 may be as little as 10°, 15°, 18° or 20°, or may be as great as 22°, 25°, or 30°, or may be within any ranged defined between any two of the foregoing values, such as between 10° and 30°. In one particular exemplary embodiment, angle 58 is between 20° and 22°. In a more particular exemplary embodiment, angle 58 is 20° or 22°.

Figure 4:
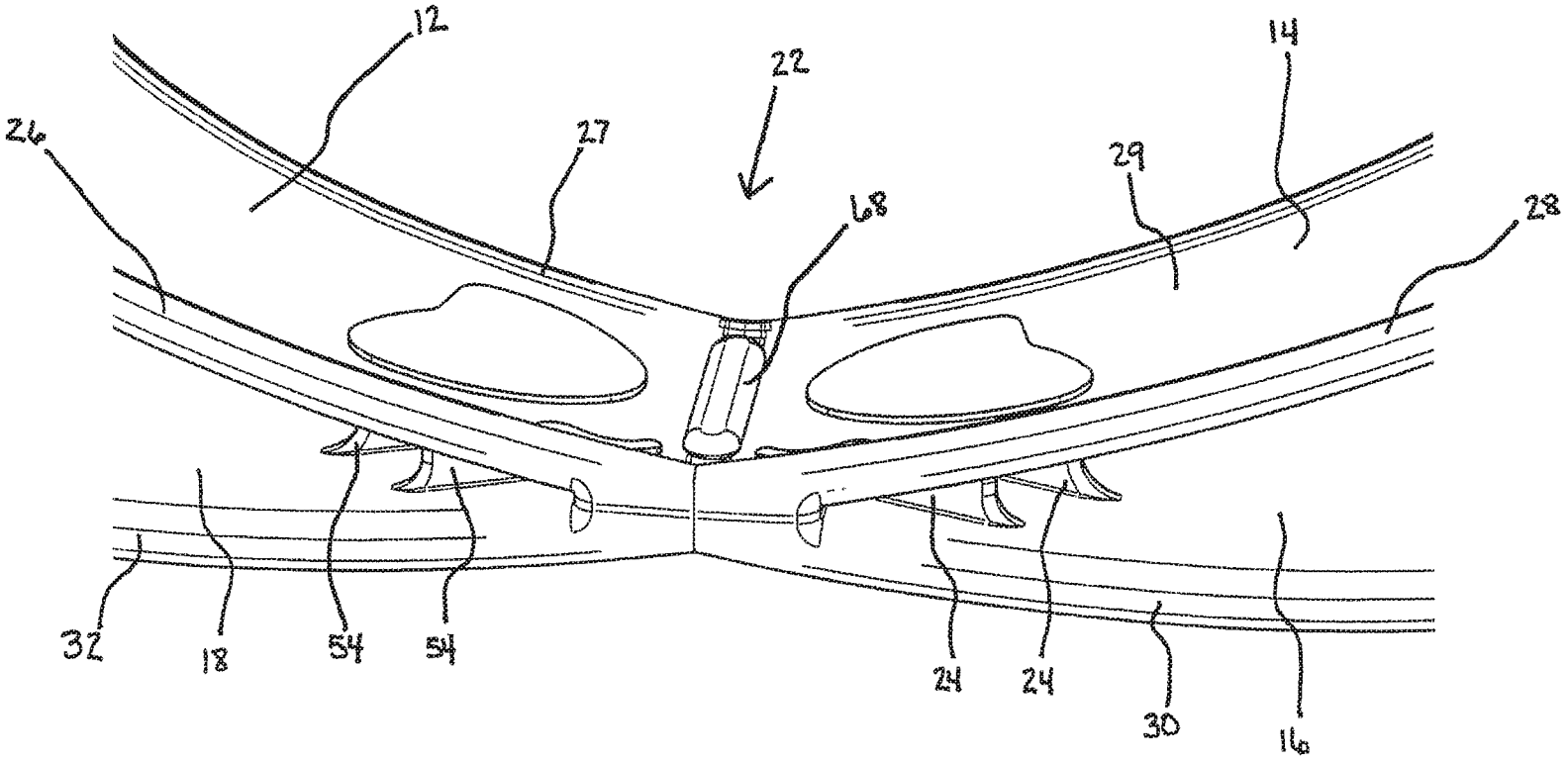
FIG. 4 is an enlarged perspective view of a portion of the flying disc device of FIG. 1, illustrating one of two antipodal junctions of the flying disc device.
Figure 5:
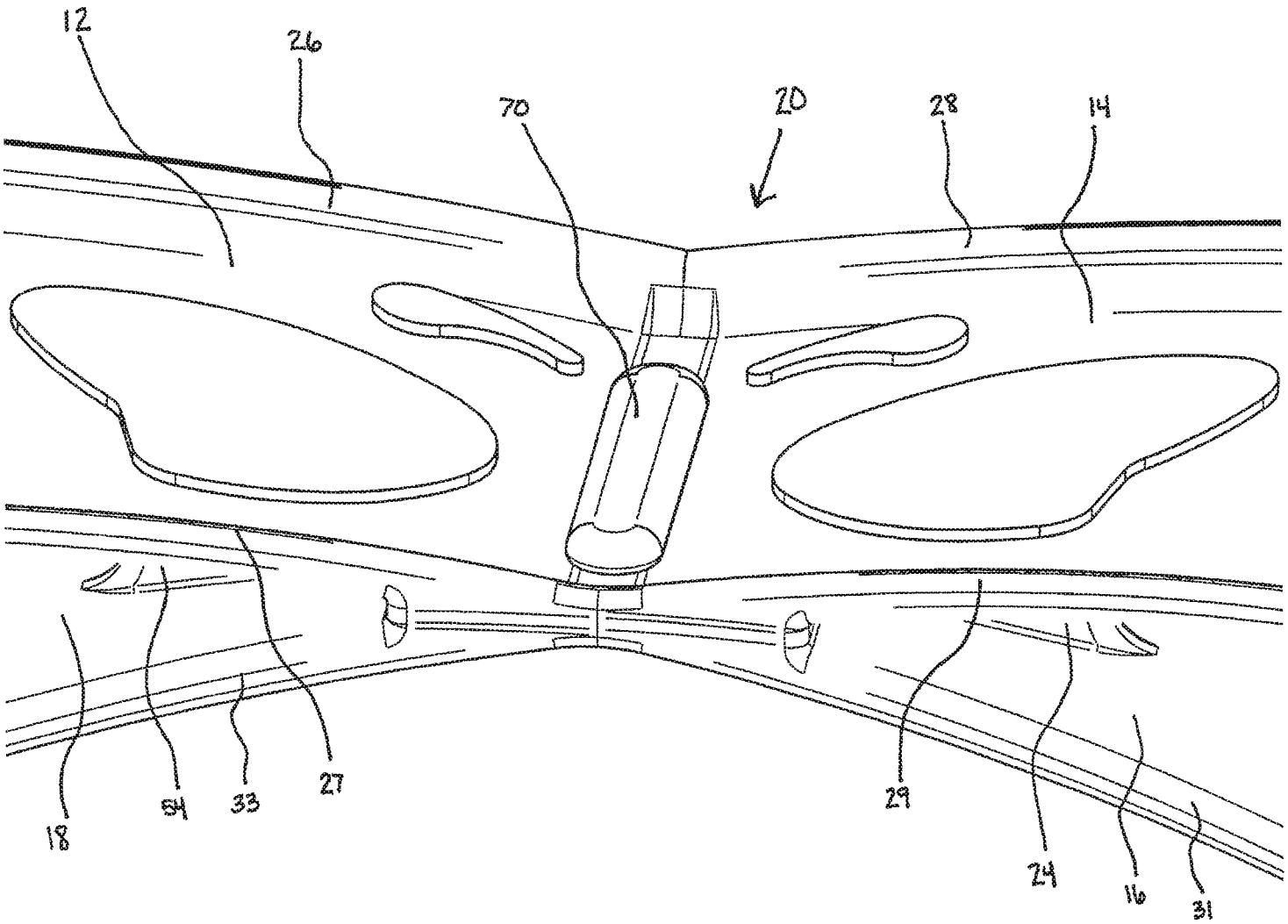
FIG. 5 is another enlarged perspective view of a portion of the flying disc device of FIG. 1, illustrating one of two antipodal junctions of the flying disc device.
Figure 6:
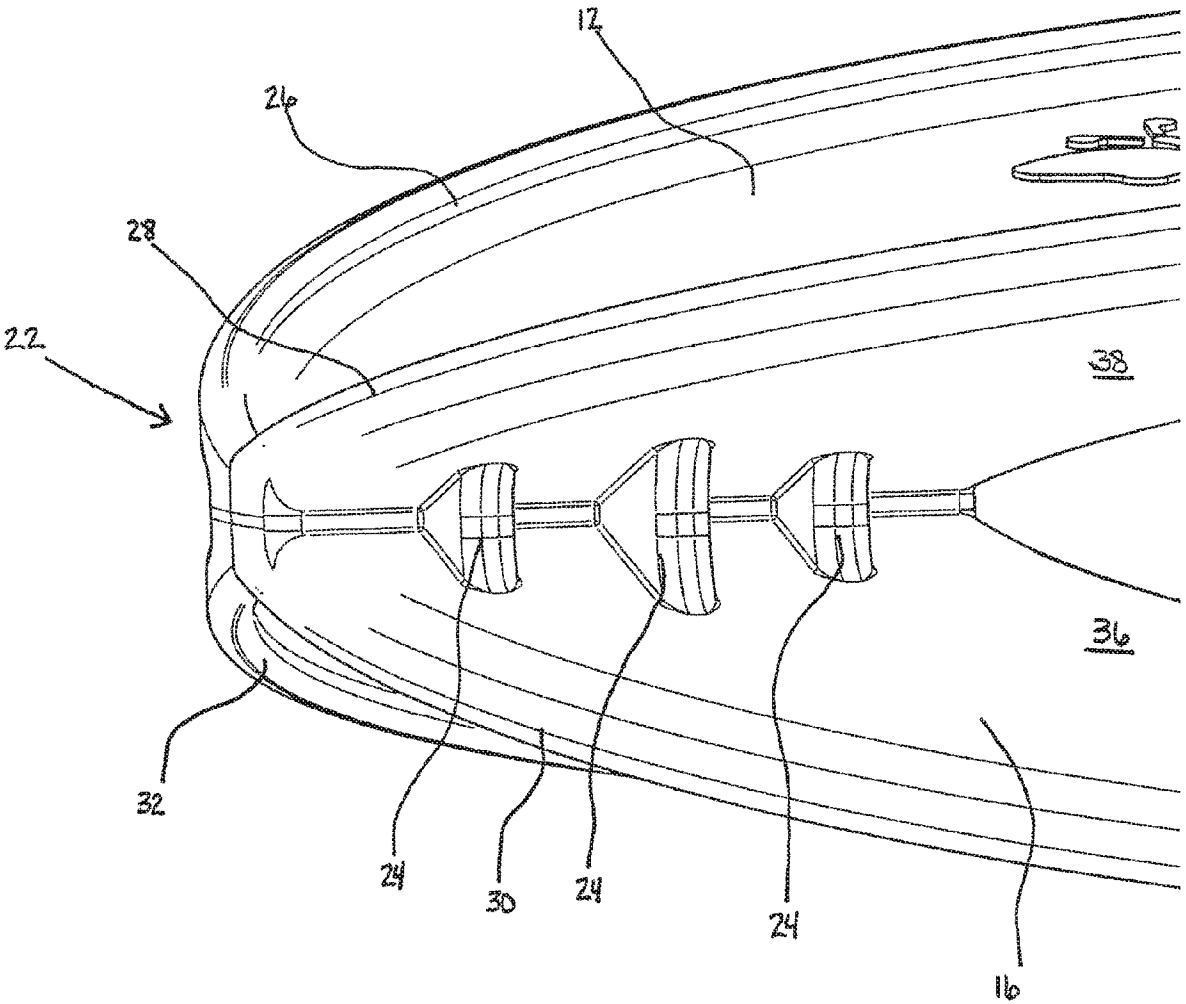
FIG. 6 is an enlarged perspective view of the flying disc device of FIG. 1, illustrating a joint at an antipodal junction with a rib structure for junction reinforcement.
Figure 7:
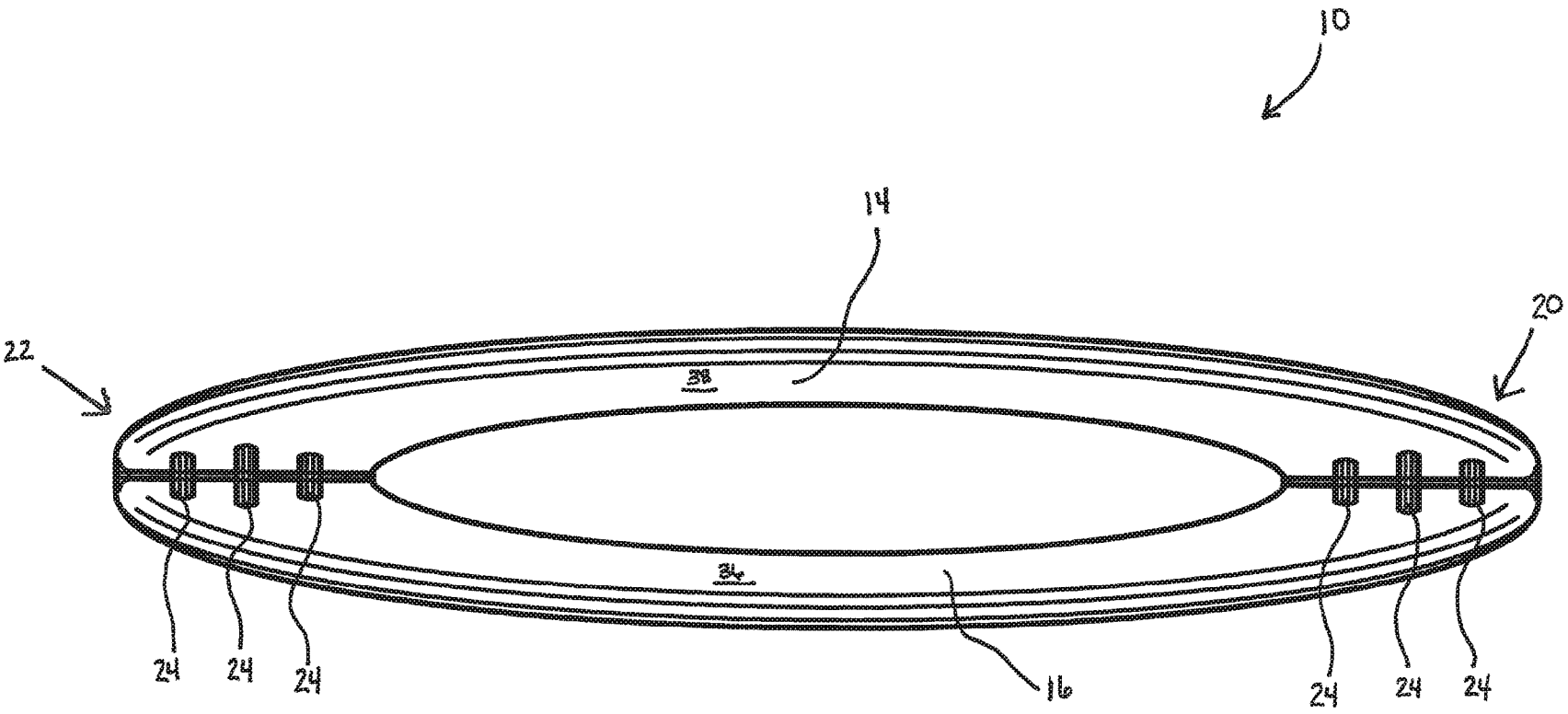
FIG. 7 is a front, elevation view of the flying disc device of FIG. 1.

Annular ring halves 12, 18 and 14, 16 each extend away from intersection regions 20 and 22 as partially shown in FIGS. 4-5. To maintain disc angle 58 as described earlier, a plurality of joiner ribs 24, 54 are positioned adjacent to antipodal junctions 66 and 68 (FIG. 1) to stabilize and reinforce annular ring halves 12, 14, 16, and 18 at high stress areas of flying disc device 10, i.e., at junctions 66, 68. This reinforcement helps flying disc device 10 maintain its shape during normal use (e.g., throwing and catching by humans and canines), and avoids fracture or other material failure at the high stress areas. As best shown in FIG. 6-7, joiner ribs 24 contact the lower surface 38 of annular ring half 14 and the upper surface 36 of annular ring half 16. Joiner ribs 24 also span the vertical distance between lower surface 38 and upper surface 36. Similarly, joiner ribs 54 contact lower surface 42 of annular ring half 12 and upper surface 48 of annular ring half 18 Joiner ribs 54 also span the vertical distance between lower surface 42 and upper surface 48 as shown in FIGS. 9 and 12. In the illustrated embodiment, the plurality of joiner ribs 24, 54 are formed of the same material as annular ring halves 12, 14, 16, and 18. For example, all the parts of flying ring 10 may be monolithically formed as a single component as further described below.

Annular rings 62 and 64 may also include annular ribs disposed along the outer peripheries of annular rings 62 and 64. As shown in at least FIG. 1, flying disc device 10 includes annular ribs 26, 28, 30, and 32 joined to annular ring halves 12, 14, 16, and 18, respectively. In the illustrated embodiment, annular ribs 26 and 28 are positioned along the outer peripheries of annular ring halves 12 and 14, respectively, such that annular ribs 26, 28 extend upwardly from annular ring halves 12 and 14 and away from their adjacent upper surfaces. Also, annular ribs 30 and 32 are positioned along the outer peripheries of annular ring halves 16 and 18, respectively, such that annular ribs 30, 32 extend downwardly from annular ring halves 16 and 18 and away from their adjacent lower surfaces. As a result, annular rings 62 and 64 have a portion of its outer periphery (e.g., half of its circumference) with an annular rib that extends upwardly and another portion of its outer periphery (e.g., the opposing half of its circumference) with an annular rib that extends downwardly. It is contemplated that each of annular ribs 26, 28, 30, and 32 may extend upwardly or downwardly from their respective annular ring halves independently of each other, or that such ribs may extend both upwardly and downwardly from the edges of ring halves 12, 14, 16, and 18 as required or desired for a particular application.

In an alternate embodiment, inner annular ribs 27, 29, 31, 33, as respectively shown in at least FIGS. 1, 2, 4, 5, 10, and 11, are positioned along inner peripheries of annular rings 62, 64. Inner annular ribs 27, 29, 31, 33 extend generally in the same direction as annular ribs 26, 28, 30, 32 such that the inner annular ribs 27, 29, 31, and 33 are substantially parallel with annular ribs 26, 28, 30, 32.

Figure 14:
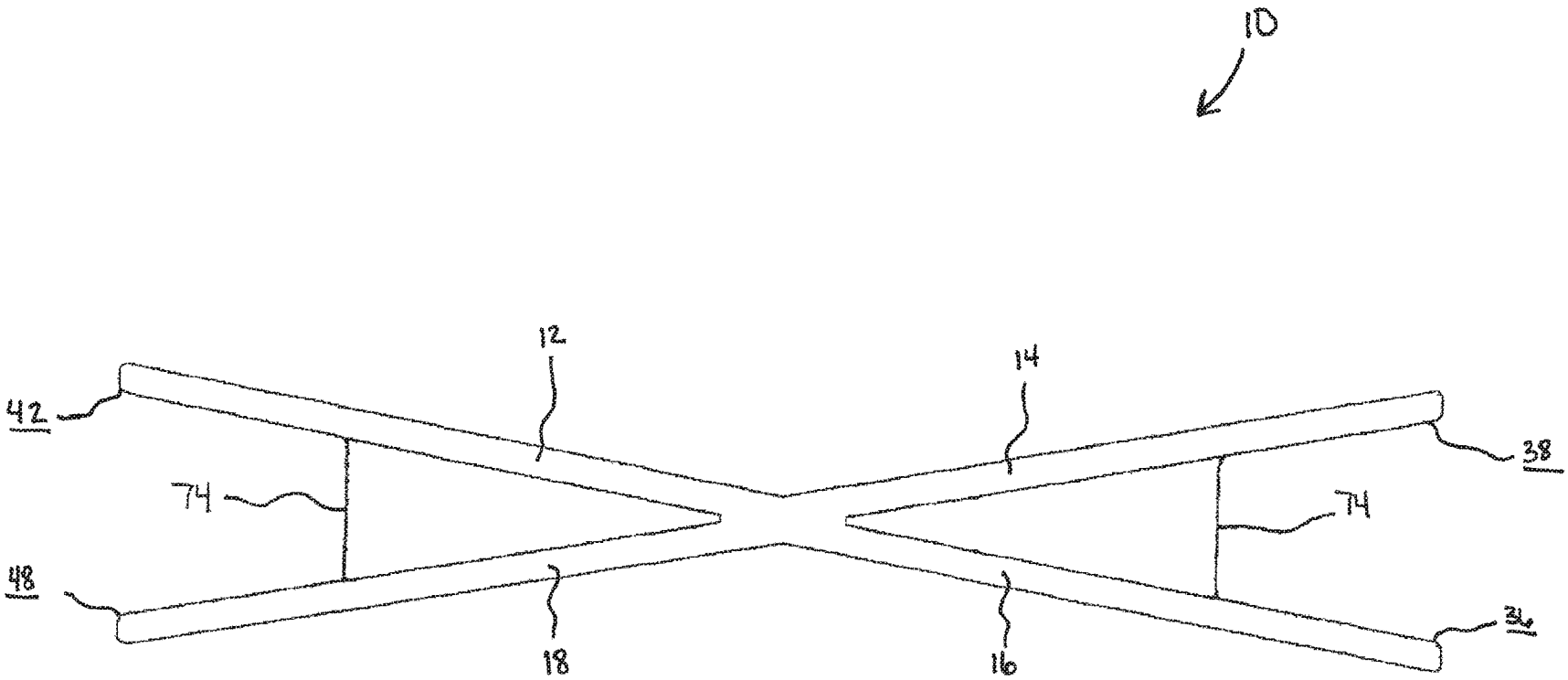
FIG. 14 is a side elevation view of an alternate embodiment of the flying disc device of FIG. 1.
Figure 15:
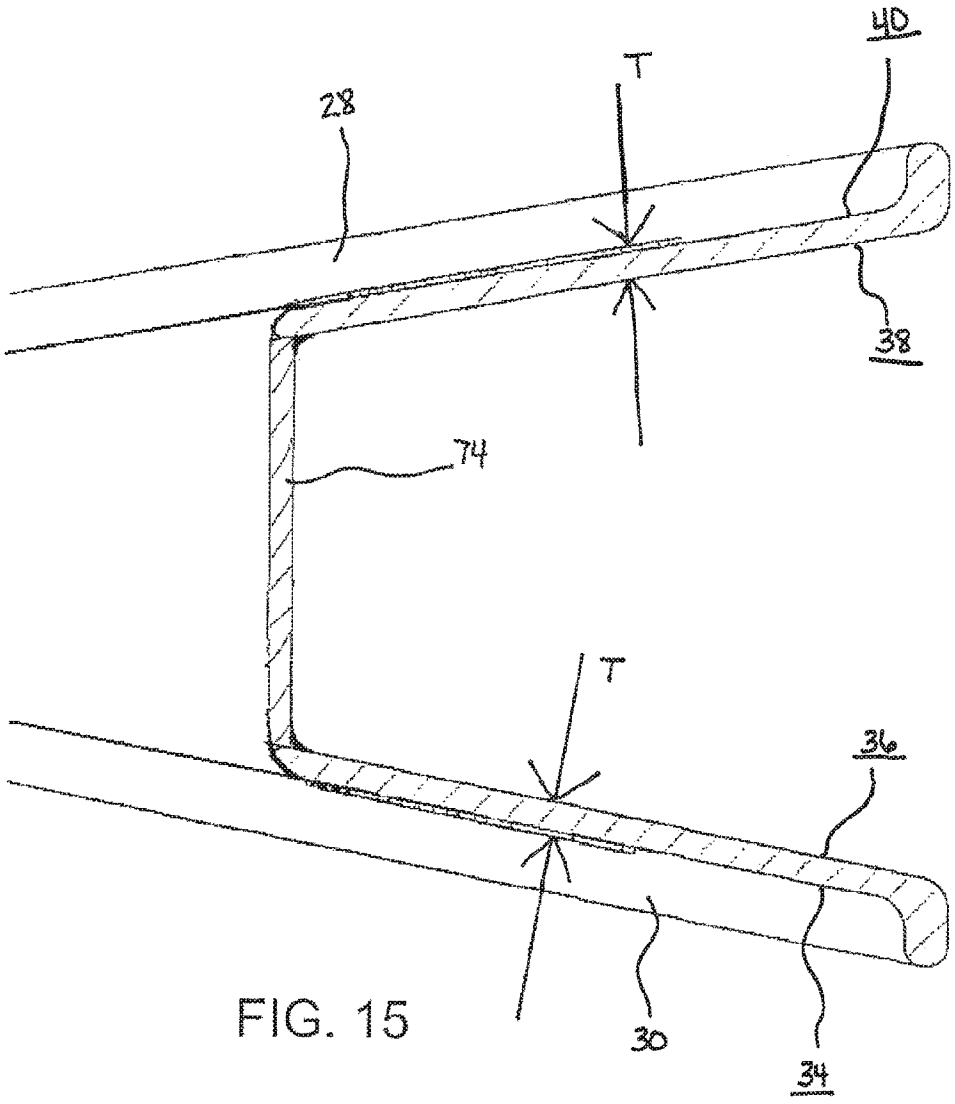
FIG. 15 is an enlarged elevation, section view of a portion of the flying disc device of FIG. 14.

In a further alternate embodiment, a gap-closure sheet 74 shown in FIGS. 14 and 15 contacts the inner peripheries of annular rings 62, 64 and spans the vertical distance between the inner peripheries of the ring such that the sheet closes the gap between upper surface 36 and lower surfaces 38 and upper surface 48 and lower surfaces 42 along the inner peripheries of annular rings 62 and 64. In an exemplary embodiment, this gap-closure sheet 74 is made from the same material as annular rings 62 and 64.

In the illustrated embodiment, flying disc device 10 is made of two annular rings 62, 64 that are coupled together as described above. Annular ring halves 12, 14, 16, and 18 may be welded together at intersection regions 20 and 22 to form flying disc device 10. In an alternate embodiment, annular ring halves 12, 14, 16, and 18 may be glued together to form flying disc device 10. In an alternate embodiment, flying disc device 10 may be monolithically formed as a single part, such as by injection molding.

The weight of flying disc device 10 also affects the flying ability of flying disc device 10. If the weight of flying disc device 10 is too large, flying disc device 10 does not spin well while in flight and does not appear to float on wind pockets (the movement of flying disc device 10 will not be crisp and fluid). A large weight also makes flying disc device 10 difficult for a user to catch as the impact upon a user's hand would be greater when flying disc device 10 is heavier. If the weight is too low, flying disc device will not carry enough momentum to sufficiently overcome air resistance for a suitably long flight. In an exemplary embodiment, flying disc device 10 may weigh as little as 1 ounce, 1.5 ounces, 2 ounces, or 2.5 ounces as much as 3 ounces, 5 ounces, 6 ounces, 8 ounces, or 10 ounces, or may have any weight within any range defined between any two of the foregoing values, such as 2.5 ounces to 3.5 ounces or 1 ounce to 10 ounces. In an alternate embodiment, flying disc device 10 weighs 3.1 ounces.

Flying disc device 10 also maintains a uniform weight to outer diameter ratio such that flying disc device is able to fly well. If the weight to outer diameter ratio is too great, flying disc device 10 will be too heavy to fly well, resulting in either no significant flight or a flight of short duration that is unappealing to the user. If the weight to outer diameter ratio is too low, flying disc device 10 will be too flimsy to be thrown by the user, and the user will have substantially no control over the flight of flying disc device 10 (e.g., the movement of flying disc device 10 will not be crisp and fluid). Exemplary flying disc devices 10 have a weight to outer diameter ratio of as little as 0.35, 0.40, 0.45, or 0.50 as much as 0.55, 0.60, 0.65, or 0.70, or may have any weight within any range defined between any two of the foregoing values, such as 0.40 to 0.55.

The materials used in flying disc device 10 may be chosen to achieve a desired strength, weight and flexibility of flying disc device 10. Flying disc device 10 is generally made of flexible, polymeric materials that also add durability to flying disc device 10. The materials also allow flying disc device 10 to be elastically deformable such that when a force is applied onto flying disc device 10, flying disc device 10 will deform in response to the applied force, but flying disc device 10 will return to its original configuration once the force is no longer applied onto flying disc device 10. This material property is advantageous when using flying disc device 10 with animals (e.g., dogs, canines, etc.) because flying disc device 10 will elastically deform when the animal chews or bites down on flying disc device 10; but, flying disc device 10 will return to its original configuration upon release by the animal. Furthermore, the materials of flying disc device 10 are non-toxic such that the disc device is suitable for use by humans and animals. In one exemplary embodiment, flying disc device 10 is made of polypropylene. In an alternative embodiment, flying disc device 10 is made of polyurethane or polyethylene. Polypropylene gives flying disc device 10 some flexibility and adequate strength for a given weight. Additionally, polypropylene makes flying disc device 10 less brittle, which enhances the durability of flying disc device 10 and prolongs the life of flying disc device 10.

The shape and configuration of flying disc device 10 enables flying disc device 10 to appear as if it is fluttering, in the manner of a butterfly flapping its wings, when in flight. This gives a pleasing and interesting visual appearance in flight, and also helps the user to see device 10 from a distance. Specifically, annular rings 62, 64 rotate in flight and may also vertically oscillate in response to the changing air pressure along surfaces 34, 36, 38, 40, 42, 44, 46, and 48 of annular rings 62, 64.

The structure of flying disc device 10 also yields advantages to the user. The ring-like structure as opposed to the shape of traditional flying discs (e.g., dome-shaped) makes flying disc device 10 more desirable for use with animals (e.g., dogs or canines). The presence of the aperture in the middle of flying disc device 10 allows an animal easy access to firmly grasp flying disc device 10 with their mouth when flying disc device 10 is at rest. By contrast, when a traditional flying disc is lying with the dome-shape pointing upwards, an animal is required to reach underneath the flying disc to flip it over such that the dome portion of the flying disc is pointing downwards towards the ground. Then, the animal can bite flying disc to pick it up. This two-step process may prove to be difficult for some animals especially when the ground is not forgiving, such as cement, asphalt, or concrete. In addition, because the portion of flying disc device 10 near intersection regions 20 and 22 is elevated from the ground, the animal or human can easily reach underneath intersection regions to "scoop" ring 10 up and easily gain a firm grasp.

Annular ribs 26, 28, 30, and 32 make catching flying disc device 10 less painful for a user. Annular ribs 26, 28, 30, and 32 provide a duller surface along the outer peripheries of annular rings 62, 64 so that there is less impact when a user's hand or extremity makes contact with flying disc device 10.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A flying disc comprising:

a first annular ring and a second annular ring only;

the first annular ring defining a first plane, a first longitudinal axis perpendicular to the first plane, a first outer annular diameter and a first inner annular diameter; and the second annular ring defining a second plane, a second longitudinal axis perpendicular to the second plane, a second outer annular diameter and a second inner annular diameter;

a first pair of antipodal points of the first annular ring joined with a corresponding second pair of antipodal points of the second annular ring such that a pair of antipodal junctions are formed between the first and second annular rings, the first annular ring skewed with respect to the second annular ring such that an angle is formed between the first and second longitudinal axes, and the angle is between 10 degrees and 30 degrees, whereby the flying disc appears to flutter in flight when rotating.

2. The flying disc of claim 1, further comprising at least one joiner rib is affixed to the first annular ring and the second annular ring at least one of the respective antipodal junctions.

3. The flying disc of claim 1, further comprising at least one annular rib formed around an outer periphery of at least one of the first annular ring and the second annular ring.

4. The flying disc of claim 1, wherein:

the first outer diameter is substantially equal to the second outer diameter; and the first inner diameter is substantially equal to the second inner diameter.

5. The flying disc of claim 4, wherein the first and second outer diameters are between 4 inches and 18 inches, whereby the flying disc is suitable as a hand-held throwable toy.

6. The flying disc of claim 1, wherein:

the first annular ring defines a first axial thickness; and the second annular ring defines a second axial thickness substantially equal to the first axial thickness.

7. The flying disc of claim 6, further comprising at least one thickened portion adjacent at least one of the antipodal junctions, the thickened portion greater than the first and second axial thicknesses whereby the antipodal junctions are strengthened by the at least one thickened portion.

8. The flying disc of claim 7, wherein the at least one thickened portion comprises a thickened portion adjacent each of the two antipodal junctions.

9. The flying disc of claim 7, wherein the first and second annular rings are made of a polymer material and the first and second axial thicknesses cooperate with the first and second inner diameters and first and second outer diameters to result in an overall weight of the flying disc between 1 ounce and 10 ounces.

10. The flying disc of claim 1, wherein the first annular ring and the second annular ring are made of a polymer material.

11. The flying disc of claim 1, further comprising an inner layer formed around an inner periphery of the first annular ring and an inner periphery of the second annular ring, whereby the inner layer extends over a space between the inner periphery of the first annular ring and the inner periphery of the second annular ring.

12. The flying disc of claim 1, wherein:

the first annular ring comprises a first annular disc having a first width dimension and a first height dimension, wherein the first width dimension is greater than the first height dimension; and the second annular ring comprises a second annular disc having a second width dimension and a second height dimension, wherein the second width dimension is greater than the second height dimension.

13. The flying disc of claim 1, wherein:

the first outer diameter is between 8 inches and 16 inches;

a first width defined as a difference between the first outer diameter and the first inner diameter is between 1 inch and 3 inches;

the second outer diameter is between 8 inches and 16 inches; and a second width defined as a difference between the second outer diameter and the second inner diameter is between 1 inch and 3 inches, whereby the flying disc is sized to be used as a throwing toy.

14. A flying disc comprising:

a first annular ring and a second annular ring only;

the first annular ring defining a first plane, a first longitudinal axis perpendicular to the first plane, a first outer annular diameter and a first inner annular diameter; and the second annular ring defining a second plane, a second longitudinal axis perpendicular to the second plane, a second outer annular diameter and a second inner annular diameter;

a first pair of antipodal points of the first annular ring joined with a corresponding second pair of antipodal points of the second annular ring such that a pair of antipodal junctions are formed between the first and second annular rings, the first annular ring skewed with respect to the second annular ring such that an angle is formed between the first and second longitudinal axes, and at least one annular rib formed around an outer periphery of at least one of the first annular ring and the second annular ring, the at least one annular rib extending axially away from at least one of a surface of the first annular ring and a surface of the second annular ring.

15. The flying disc of claim 14, wherein the angle formed between the first and second longitudinal axes is between 10 degrees and 30 degrees.

16. The flying disc of claim 14, further comprising at least one joiner rib affixed to the first annular ring and the second annular at least one of the respective antipodal junctions.

17. The flying disc of claim 16, wherein the joiner rib is formed at both sides of each of the respective antipodal junctions.

18. The flying disc of claim 14, wherein the first and second outer diameters are between 4 inches and 18 inches, whereby the flying disc is suitable as a hand-held throwable toy.

19. The flying disc of claim 14, wherein:

the first annular ring defines a first axial thickness; and the second annular ring defines a second axial thickness substantially equal to the first axial thickness.

20. The flying disc of claim 19, wherein the first and second annular rings are made of a polymer material and the first and second axial thicknesses cooperate with the first and second inner diameters and first and second outer diameters to result in an overall weight of the flying disc between 1 ounce and 10 ounces.

21. The flying disc of claim 14, wherein the first annular ring and the second annular ring are made of a single piece of monolithically formed material.

22. The flying disc of claim 14, further comprising an inner layer formed around an inner periphery of the first annular ring and an inner periphery of the second annular ring, whereby the inner layer extends over a space between the inner periphery of the first annular ring and the inner periphery of the second annular ring.

* * * * *